US008057119B2

(12) United States Patent
Zhang

(10) Patent No.: US 8,057,119 B2
(45) Date of Patent: Nov. 15, 2011

(54) COSMETIC APPLYING DEVICE

(75) Inventor: Jun Zhang, Sijhih (TW)

(73) Assignee: Chuen Chern Co., Ltd., Taipei (TW)

( * ) Notice: Subject to any disclaimer, the term of this patent is extended or adjusted under 35 U.S.C. 154(b) by 313 days.

(21) Appl. No.: 12/432,041

(22) Filed: Apr. 29, 2009

(65) Prior Publication Data

US 2010/0278580 A1 Nov. 4, 2010

(51) Int. Cl.
*A46B 11/04* (2006.01)

(52) U.S. Cl. ..... 401/270; 401/269

(58) Field of Classification Search ..... 401/184, 401/269, 270, 280
See application file for complete search history.

(56) References Cited

U.S. PATENT DOCUMENTS 7,377,711 B2 * 5/2008 Byun ..... 401/269
7,488,133 B2 * 2/2009 Kuo ..... 401/281

* cited by examiner

*Primary Examiner* — Huyen Le

(57) ABSTRACT

A cosmetic applying device includes a soft tube with an end member connected to the open end of the soft tube in which fluid cosmetic material is received. The end member has two through holes in the closed end and an engaging portion extending from an inner end of the closed end. A core piece has an end inserted into the end member and an applying head extends through a passage in the core piece. A cap is threadedly connected to the soft tube to protect the applying head. When the cap is connected to the soft tube, the passage of the core piece is sealed by the engaging portion to prevent air and cosmetic material from entering the soft tube. When the cap is removed from the soft tube, the core piece is moved and the engaging portion is disengaged from the passage.

8 Claims, 8 Drawing Sheets

COSMETIC APPLYING DEVICE

FIELD OF THE INVENTION

The present invention relates to a cosmetic applying device, and more particularly, to a cosmetic applying device for applying fluid cosmetic material and the cosmetic material cannot flow back into the soft tube when not in use.

BACKGROUND OF THE INVENTION

A conventional cosmetic applying device for applying fluid cosmetic material is shown in FIG. 1, and generally includes a hollow applying head which is connected to a soft tube in which the fluid cosmetic material is received. The fluid cosmetic material flows through the hollow applying head by squeezing the soft tube. However, when the user does not use the cosmetic applying device, the fluid cosmetic material mixed with air flow back into the soft tube and the air can easily contaminate the cosmetic material. Furthermore, the cosmetic material is solidified when mixing with air and dust and germs in the air may change the nature of the cosmetic material and be harmful to the users.

The present invention intends to provide an improved cosmetic applying device which seals the soft tube to prevent the surplus cosmetic material and air from entering the soft tube to improve the shortcoming of the convention cosmetic applying device.

SUMMARY OF THE INVENTION

The present invention relates to a cosmetic applying device which comprises an applying head extending through a passage of a core piece and a stepped skirt extends from an outer periphery of the core piece. An inner collar is engaged with an inner periphery of the passage to position the applying head. A first protrusion extends radially outward from the core piece. A soft tube has an opening defined in a first end thereof and a first connection portion is defined in an outer periphery of the first end of the soft tube. A first shoulder extends inward from an inner periphery of the opening. A cap has a second connection portion so as to be connected to the first connection portion of the soft tube. A second shoulder extends from an inner periphery of the cap. An end member includes a first end and a closed second end. A flange extends radially outward from the first end of the end member and a chamber is defined in the end member and communicates with an opening of the first end of the end cap. An engaging portion extends from an inner end of the closed second end and toward the opening of the first end of the end cap. A second protrusion extends inward from an inner periphery of the chamber. An outer collar is connected to an outer periphery of the closed second end of the end member and at least one through hole is defined through the closed second end of the end member. The flange is rested on an end surface of the opening of the first end of the soft tube and the second end of the core piece is inserted into the chamber of the end member.

When the cap is connected to the soft tube, the stepped skirt is engaged with the second shoulder of the cap and the outer collar of the end member is engaged with the first shoulder of the soft tube. The engaging portion of the end member seals the passage in the second end of the core piece. When the cap is removed from the soft tube, the core piece is moved to engage the first protrusion and the second protrusion, the passage communicates with the soft tube and the applying head, such that the fluid cosmetic material can flow through the through holes, the passage and the applying head.

The primary object of the present invention is to provide a cosmetic applying device wherein air and surplus fluid cosmetic material cannot flow back into the soft tube when the cap is connected to the soft tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
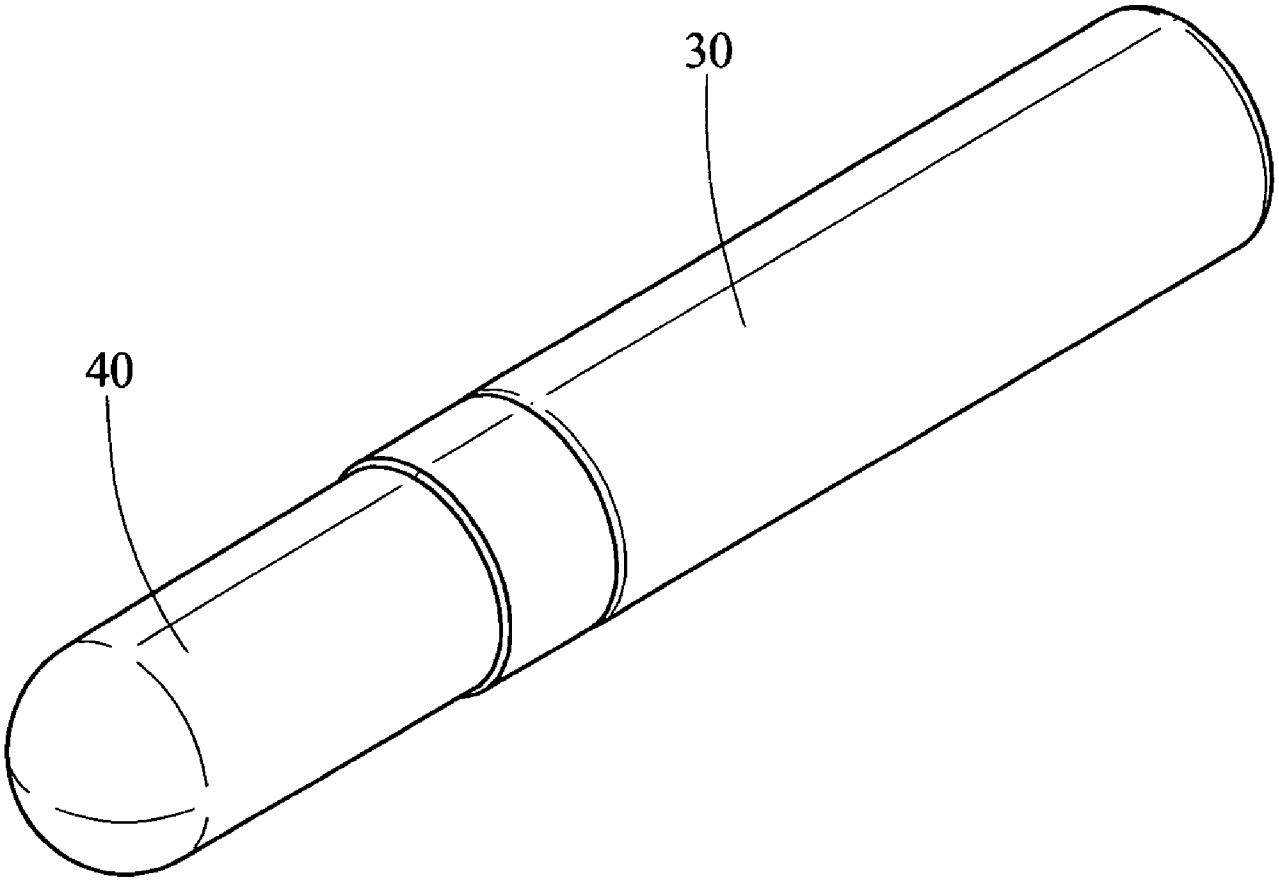
FIG. 1 is a perspective view to show the cosmetic applying device of the present invention.
Figure 2:
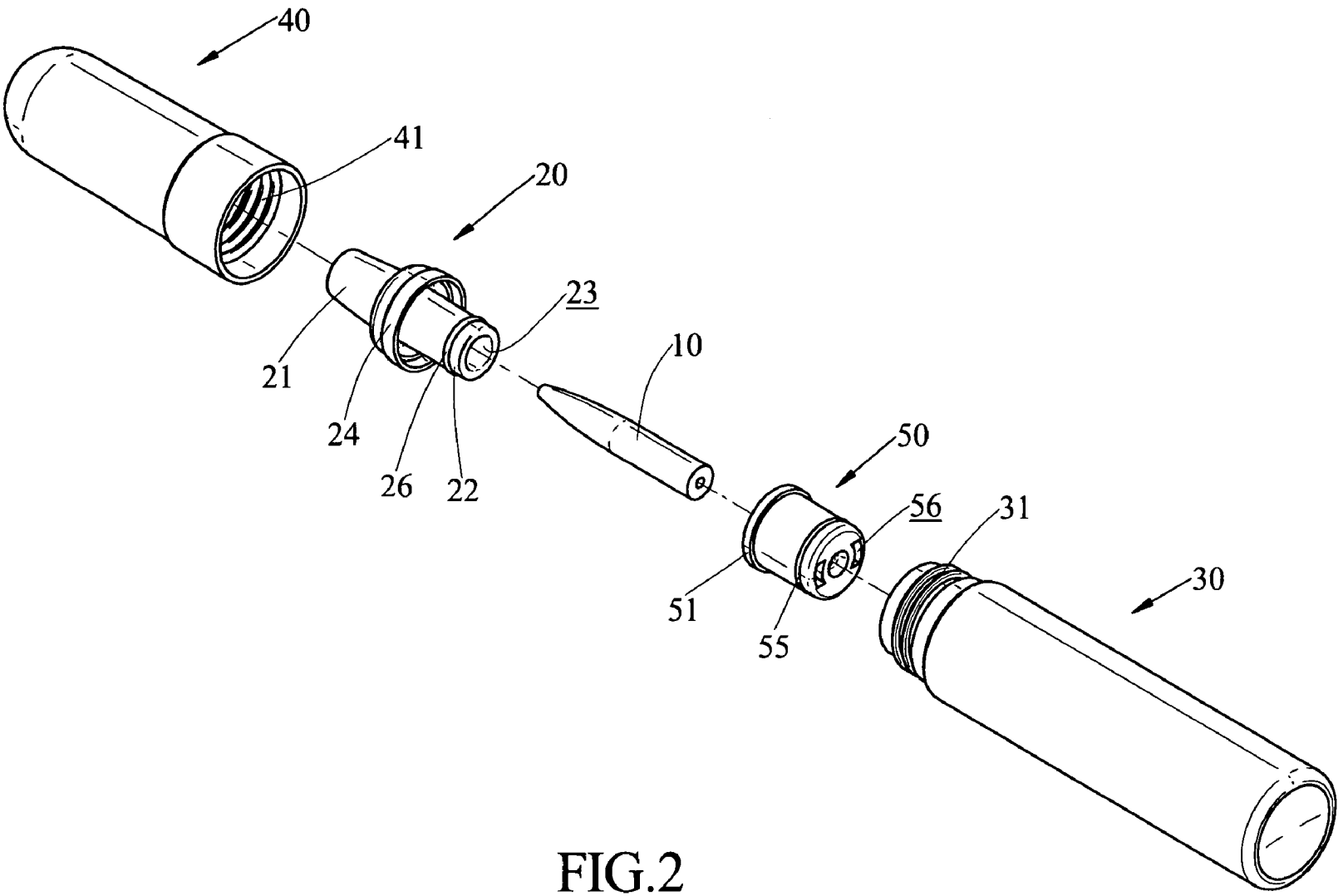
FIG. 2 is an exploded view to show the cosmetic applying device of the present invention.
Figure 3:
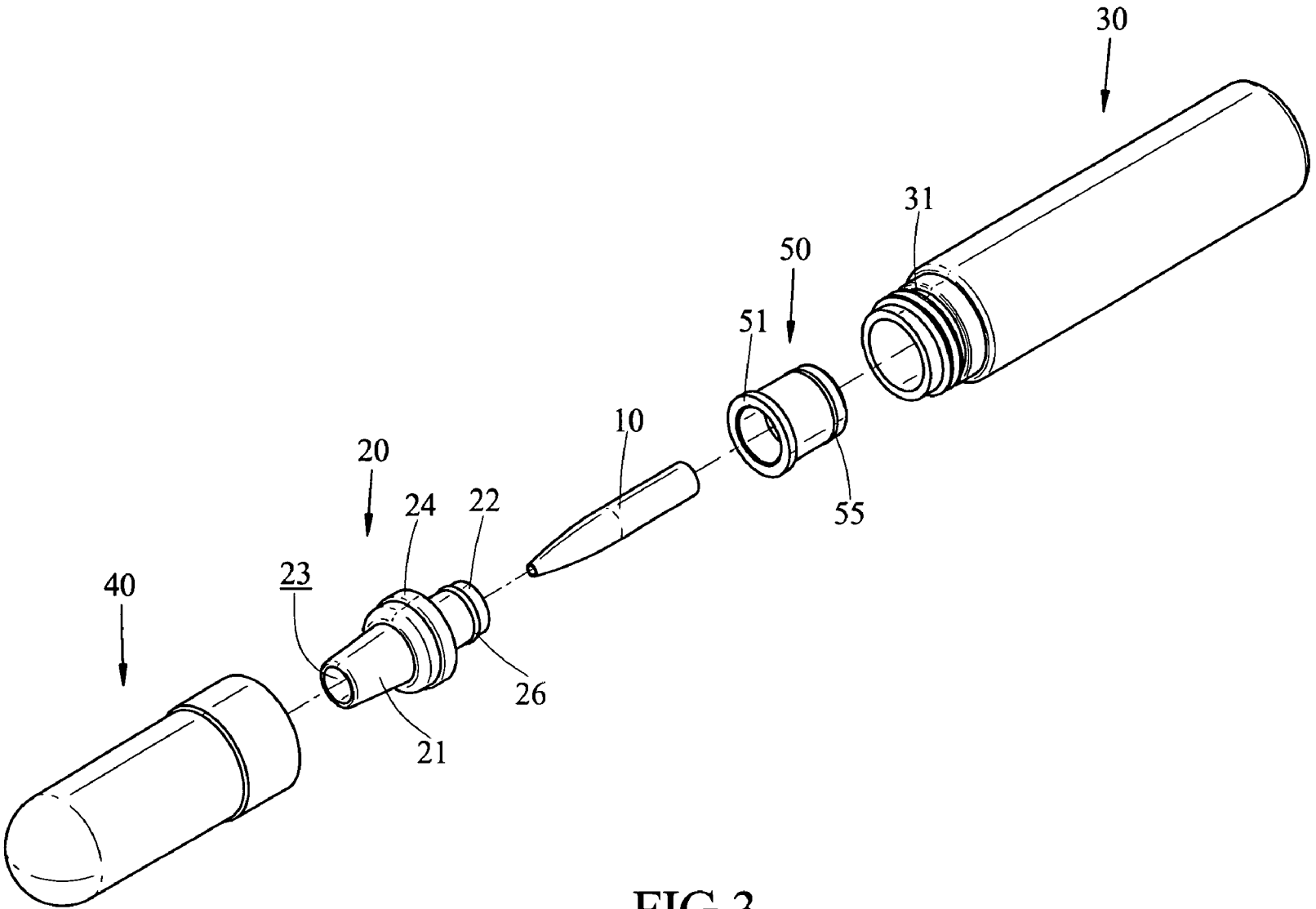
FIG. 3 is another exploded view to show the cosmetic applying device of the present invention.
Figure 4:
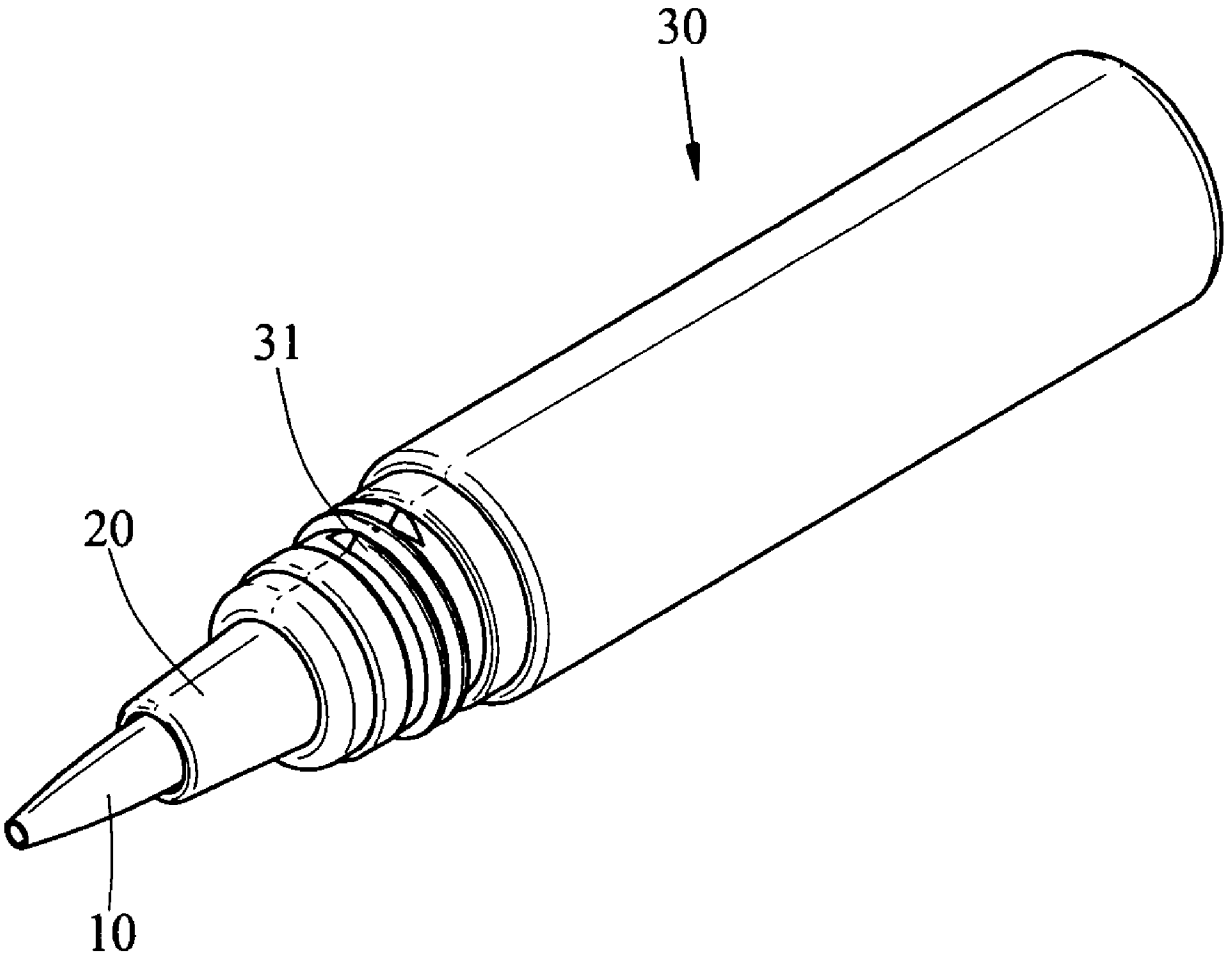
FIG. 4 is a perspective view to show the cosmetic applying device of the present invention, wherein the cap is removed from the soft tube.
Figure 5:
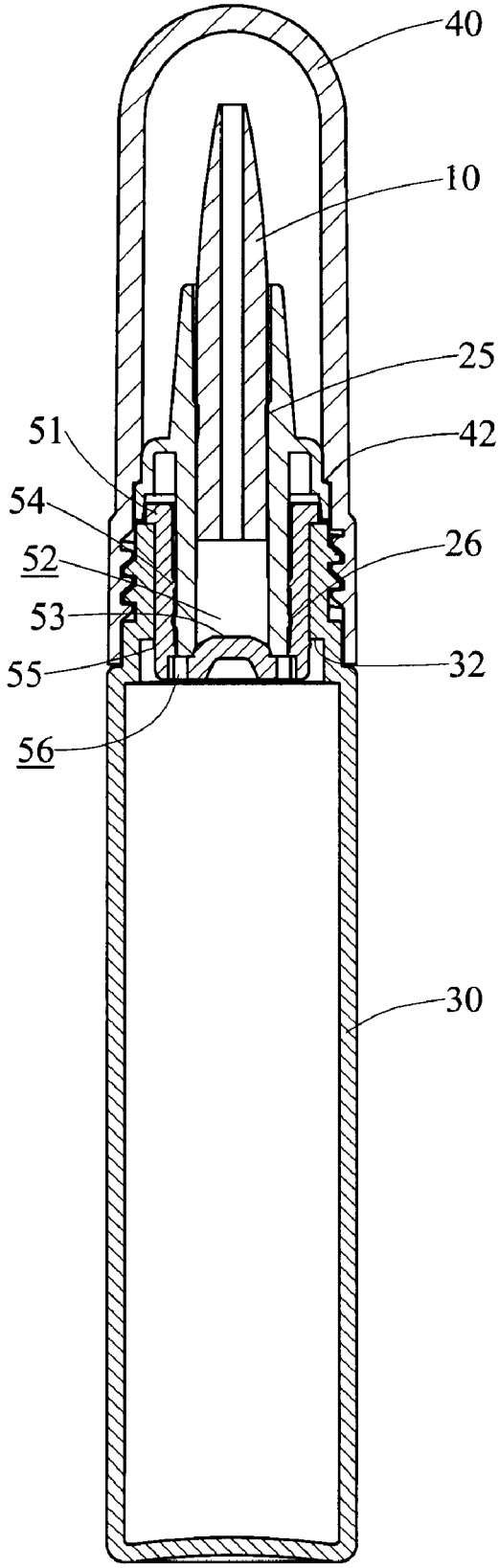
FIG. 5 is a cross sectional view to show the cosmetic applying device of the present invention.

Referring to FIGS. 2 to 5, the cosmetic applying device of the present invention comprises an applying head 10 which has a cone-shaped end and a central path defined therethrough. A core piece 20 has a first end 21 and a second end 22, wherein a passage 23 is defined centrally through the core piece 20 and an inner collar 25 is engaged with an inner periphery of the passage 23. The first end 21 of the applying head 10 is a cone-shaped end. A stepped skirt 24 extends from an outer periphery of the core piece 20 and a ring-shaped first protrusion 26 extends radially outward from the second end 22 of the core piece 20. The applying head 10 extends through the passage 23 and has a first end protruding from the first end 21 of the core piece 20. The inner collar 25 snugly secures the core piece 20 with the core piece 20.

A soft tube 30 has an opening defined in a first end thereof and a first connection portion 31 is defined in an outer periphery of the first end of the soft tube 30. A first shoulder 32 extends inward from an inner periphery of the opening. A cap 40 has a second connection portion 41 defined in an inner periphery of an opening thereof so as to be threadedly connected to the first connection portion 31 of the soft tube 30 to protect the applying head 10 from being accessed form outside. A second shoulder 42 extends from an inner periphery of the cap 40. It is noted that the outer periphery of the stepped skirt 24 is in contact with the inner periphery of the cap 40 with proper friction.

An end member 50 includes a first end and a closed second end, wherein a flange 51 extends radially outward from the first end of the end member 50. A chamber 52 is defined in the end member 50 and communicates with an opening of the first end of the end member 50. An engaging portion 53 extends from an inner end of the closed second end and toward the opening of the first end of the end member 50. A ring-shaped second protrusion 54 extends inward from an inner periphery of the chamber 52. An outer collar 55 is connected to an outer periphery of the closed second end of the end member 50 and two through holes 56 are defined through the closed second end of the end member 50. The flange 51 is rested on an end surface of the opening of the first end of the soft tube 30 and the second end of the core piece 20 inserted into the chamber 52 of the end member 50.

When the cap 40 is connected to the soft tube 30, the stepped skirt 24 is engaged with the second shoulder 42 of the cap 40 and the outer collar 55 of the end member 50 is engaged with the first shoulder 32 of the soft tube 30. The engaging portion 53 of the end member 50 seals the passage 23 in the second end of the core piece 20 so that the surplus cosmetic material in the chamber 52 and the applying head 10, and air cannot flow back into the soft tube 30.

Figure 6:
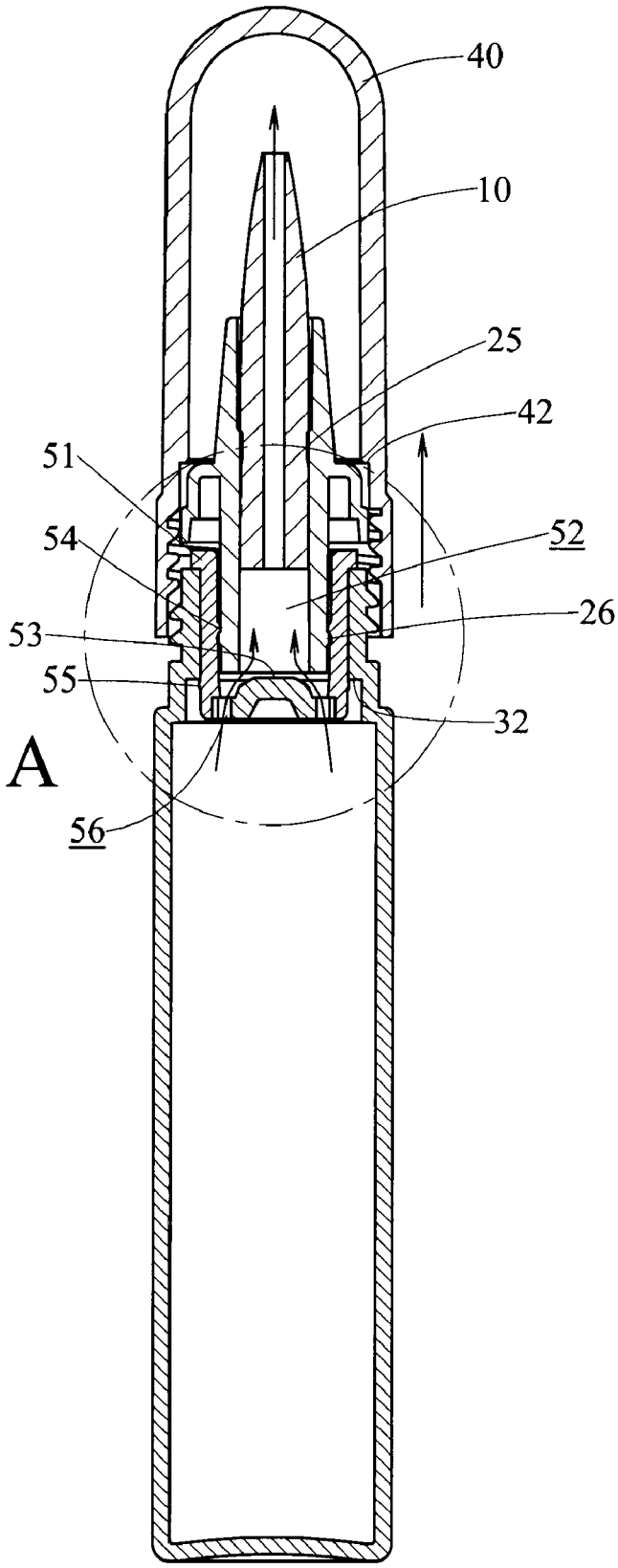
FIG. 6 is a cross sectional view to show the cosmetic applying device of the present invention, wherein the cap is moved away from the soft tube.
Figure 6A:
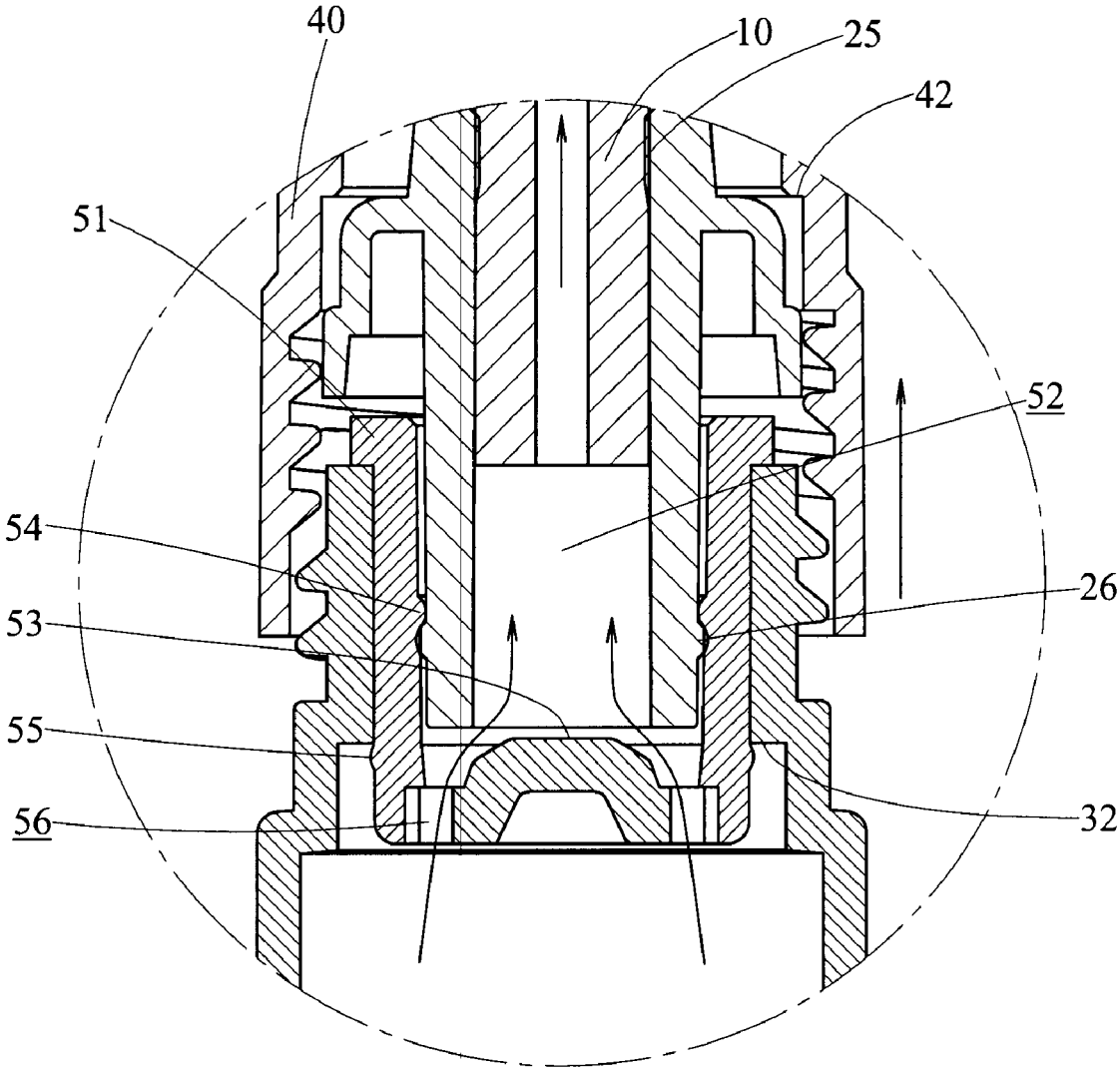
FIG. 6A is an enlarged cross sectional view to show portion circled by "A" in FIG. 6.

As shown in FIGS. 6 and 6A, when the cap 40 is unthreaded and removed from the soft tube 30, the friction between the stepped skirt 24 and the cap 40 also lifts the core piece 20 and the first protrusion 26 is stopped by the second protrusion 54. The engaging portion 53 of the end member 50 no longer seals the passage 23 in the second end of the core piece 20. The passage 23 communicates with the soft tube 30 and the applying head 10. The fluid cosmetic material in the soft tube 30 flows into the end member 50 and the applying head 10 by squeezing the soft tube 30.

Figure 7:
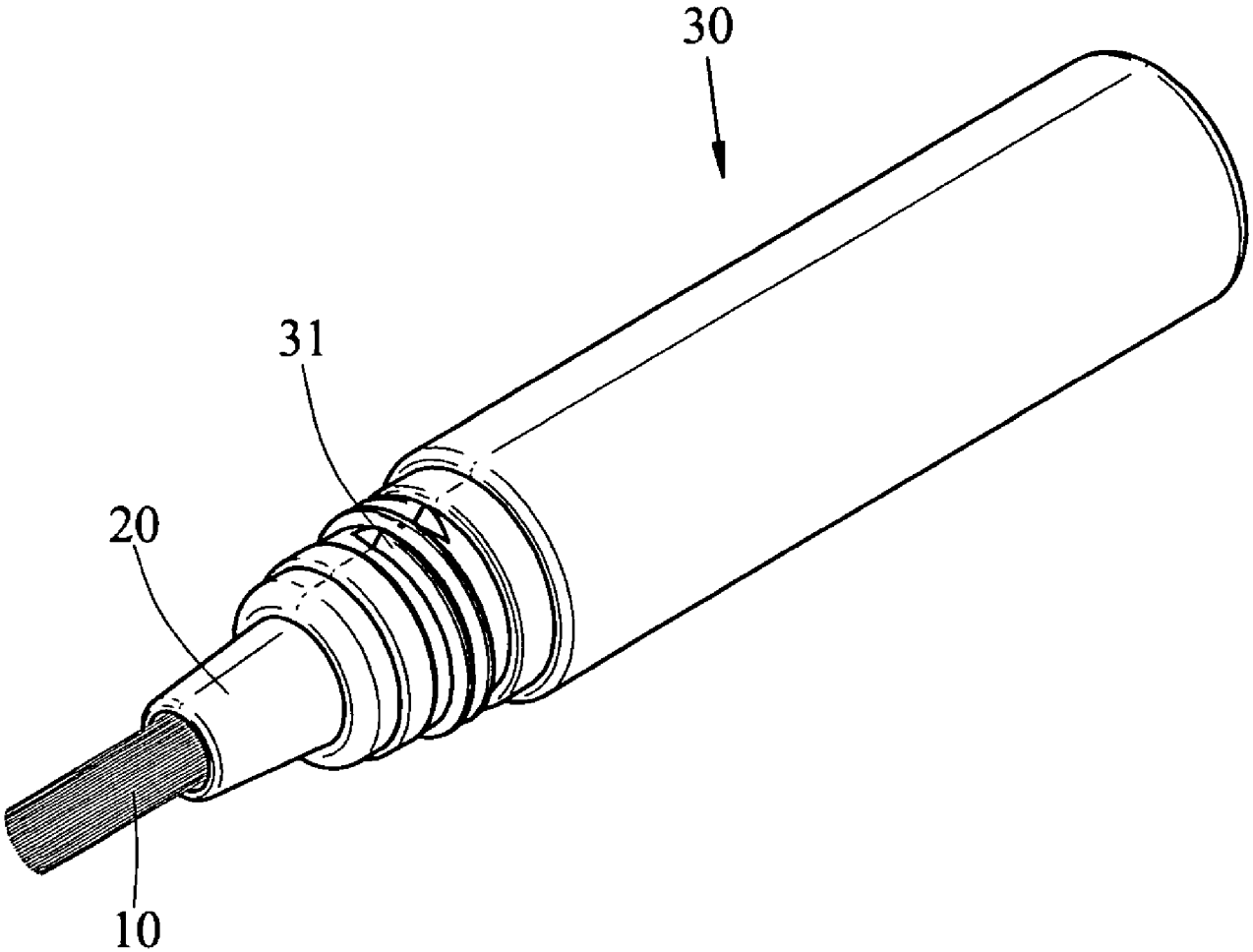
FIG. 7 shows that the applying head is a brush.

The applying head 10 can be any known applying head such as a brush as shown in FIG. 7.

While we have shown and described the embodiment in accordance with the present invention, it should be clear to those skilled in the art that further embodiments may be made without departing from the scope of the present invention.

What is claimed is:

1. A cosmetic applying device comprising:

an applying head;

a core piece having a first end and a second end, a passage defined centrally through the core piece, a stepped skirt extending from an outer periphery of the core piece and an inner collar engaged with an inner periphery of the passage, a first protrusion extending radially outward from the second end of the core piece, the applying head extending through the passage and having a first end protruding from the first end of the core piece, the inner collar snugly securing with the core piece;

a soft tube having an opening defined in a first end thereof and a first connection portion defined in an outer periphery of the first end of the soft tube, a first shoulder extending inward from an inner periphery of the opening;

a cap having a second connection portion defined in an inner periphery of an opening thereof, the second connection portion connected to the first connection portion of the soft tube, a second shoulder extending from an inner periphery of the cap;

an end member including a first end thereof and a closed second end, a flange extending radially outward from the first end of the end member, a chamber defined in the end member and communicating with an opening of the first end of the end member, an engaging portion extending from an inner end of the closed second end and toward the opening of the first end of the end member, a second protrusion extending inward from an inner periphery of the chamber, an outer collar connected to an outer periphery of the closed second end of the end member and at least one through hole defined through the closed second end of the end member, the flange rested on an end surface of the opening of the first end of the soft tube and the second end of the core piece inserted into the chamber of the end member, and when the cap is connected to the soft tube, the stepped skirt is engaged with the second shoulder of the cap and the outer collar of the end member is engaged with the first shoulder of the soft tube, the engaging portion of the end member seals the passage in the second end of the core piece, when the cap is removed from the soft tube, the core piece is moved by a friction between the stepped skirt and the cap to engage the first protrusion with the second protrusion, the engaging portion of the end member is removed from the passage in the second end of the core piece, the passage communicates with the soft tube and the applying head.

2. The device as claimed in claim 1, wherein the first connection portion is threadedly connected to the second connection portion.

3. The device as claimed in claim 1, wherein the first protrusion is a ring-shaped protrusion.

4. The device as claimed in claim 1, wherein the second protrusion is a ring-shaped protrusion.

5. The device as claimed in claim 1, wherein the end member includes two through holes.

6. The device as claimed in claim 1, wherein the first end of the core piece is a cone-shaped end.

7. The device as claimed in claim 1, wherein the applying head has a cone-shaped end.

8. The device as claimed in claim 1, wherein the applying head is a brush.

* * * * *